United States Patent [19]

Lanier et al.

[11] Patent Number: 4,479,366

[45] Date of Patent: Oct. 30, 1984

[54] EVAPORATIVE COOLER

[75] Inventors: Ted B. Lanier, Mesa, Ariz.; Ras Redwine, V, Amarillo, Tex.

[73] Assignee: RLI, Inc., Tempe, Ariz.

[21] Appl. No.: 371,786

[22] Filed: Apr. 26, 1982

[51] Int. Cl.[3] ..... F28D 5/00

[52] U.S. Cl. ..... 62/304; 261/24; 62/310

[58] Field of Search ..... 62/304, 309, 311, 310; 261/29, 24, 103, DIG. 15

[56] References Cited

U.S. PATENT DOCUMENTS

| | | | |
|---|---|---|---|
| 2,522,600 | 9/1950 | Brookins | 62/304 |
| 4,029,723 | 6/1977 | Morrison et al. | 261/29 |
| 4,289,713 | 9/1981 | Goettl | 62/310 |
| 4,312,819 | 1/1982 | Leyland | 62/310 |
| 4,419,300 | 12/1983 | Van Ness et al. | 62/304 |

*Primary Examiner*—Henry Bennett

*Attorney, Agent, or Firm*—Owen, Wickersham & Erickson

[57] ABSTRACT

An evaporative cooler is efficiently constructed of molded plastic materials, with a minimum of parts and simplicity in assembly. A blower shroud of a squirrel cage type blower extends the height of the cooler unit interiorly, and is secured by fasteners to a top panel and a base panel. Four side panels with air inlet openings are secured at their edges to the top and bottom panels. Water-retaining material is secured to the inside of each side panel, and the top edge of each side panel forms a water trough for dripping water down into the water-retaining material to be evaporated as air enters the unit. The water is circulated by a pump which draws collected water from a basin in the base panel and delivers it to the troughs.

5 Claims, 9 Drawing Figures

EVAPORATIVE COOLER

BACKGROUND OF THE INVENTION

This invention relates to air conditioning apparatus, and more particularly to an evaporative cooler or "swamp cooler" of improved, more efficient construction.

Evaporative coolers which operate generally similarly to the present invention are well known. These evaporative, or "swamp" coolers, function best in the more arid climates, cooling by evaporating water into a stream of air and delivering the cooled, moistened air to the space to be cooled.

Prior art evaporative coolers have generally been fabricated from sheet metal, and have included an internal fan or blower, generally of the squirrel cage type, with a sheet metal fan shroud connected by appropriate structure usually to a base or bottom panel and communicating with a cooled air outlet. The side panels generally had openings for drawing air from the outside into the blower, with some form of water wicking or spray apparatus interposed in the stream or streams of incoming air, to effect evaporation of water into the air and consequent cooling. These prior art apparatus generally required vertical, usually exterior corner posts between the base and top panels for holding them in proper position and holding the unit together, resulting in inconvenience and some difficulty in performing maintenance operations on the internal components of the apparatus. Prior art coolers lacked the efficient water distribution of the present invention. Also, prior art construction produced a rather heavy evaporative cooler units, and units which were subject to attact from rust or corrosion.

Prior art evaporative coolers in general have not had the advantages of efficiency in operation and maintenance and economy of construction as found in the present invention described below.

SUMMARY OF THE INVENTION

The evaporative cooler of the invention has a housing somewhat similar to prior art coolers, with a top panel, a base or bottom panel and four side panels, and with at least one and preferably more of the side panels having openings to provide air inlets. A blower is mounted within the housing, preferably of the squirrel cage type, and including a blower shroud having means for rigidly securing it to the top panel and to the bottom panel. The four panels are connected to the top panel and to the bottom panel, and the need for exterior corner posts extending vertically from the top panel to the bottom panel, as found in the prior art, is avoided. Water retaining means are attached interior of the housing, adjacent to the side panels that provide the air inlets. Water supply and delivery means are provided for efficiently wetting the water retaining medium for evaporation of water into the air as the air is drawn into the housing through the air inlets. The housing includes a cooled air outlet, communicating with the blower outlet, for delivery of the cooled, moistened air to a space.

One preferred feature of the invention is that the blower shroud, which acts as a structural member between the bottom and top panels of the cooler, is molded of structural foam reinforced with glass fibers. This is important from the standpoint of economy, corrosion resistance and structural integrity.

Another feature is that each of the side panels that include the openings has a water trough in its top edge, for receiving water pumped up from a collection basin in the base panel and distributing the water by dripping it into the water retaining means or evaporative medium, which preferably is a pad of fibrous material positioned just below the trough. Several important structural features of the water distribution system assure even distribution of water to the evaporative medium and prevention of dripping outside the air-intake panels.

Threaded fasteners are used to secure the base panel and the top panel to the molded plastic blower shroud, for ease in assembly and efficient maintenance.

Except for the motor and the blower impeller, nearly the entire assembly is formed of molded plastic material, resulting in lightness of weight, economy of manufacture and maintenance, and corrosion resistance.

It is therefore among the objects of the invention to improve on prior evaporative coolers in efficiency and economy of construction, durability, reliable operation, corrosion resistance and ease of maintenance. These and other objects, advantages, features and characteristics of the invention will be apparent from the following description of a preferred embodiment, considered along with the accompanying drawings.

DESCRIPTION OF A PREFERRED EMBODIMENT

Figure 1:
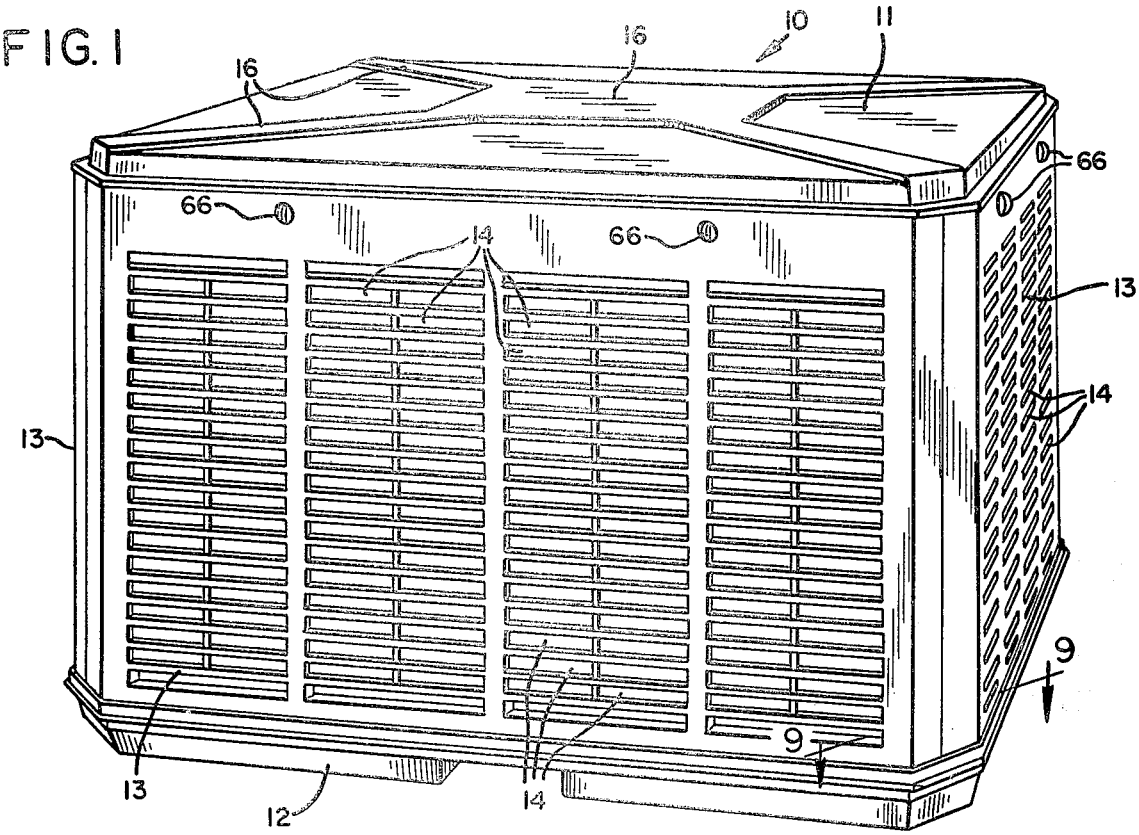
FIG. 1 is a perspective view of an evaporative cooler according to the invention.

In the drawings, FIG. 1 shows an evaporative air cooler unit 10 having an outer housing formed entirely of plastic components, including a top panel 11, a base or bottom panel 12, and side panels 13. The side panels or louver panels 13 have louver openings 14 for admitting air into which is evaporated water to cool the air, and the resultant cooled and somewhat moistened air is delivered out the bottom of the unit 10. As indicated in FIG. 1, strengthening ribs 16 are molded into the top panel 11, and they are also included in the bottom panel 12, as will be seen below.

Figure 2:
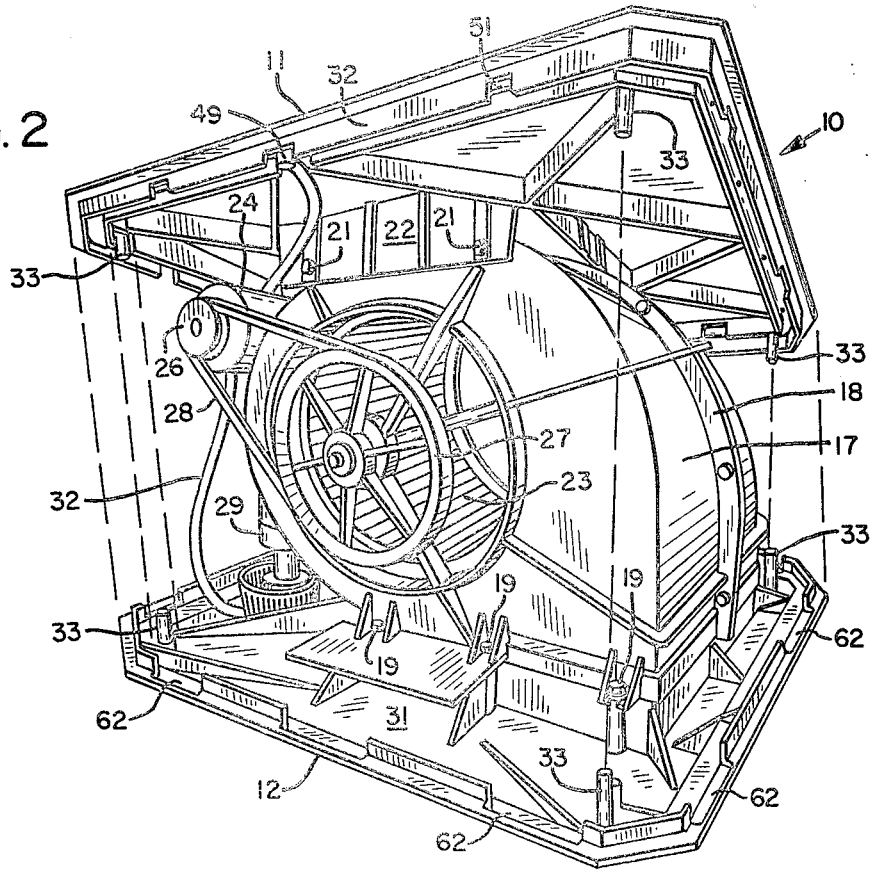
FIG. 2 is a perspective view of the evaporative cooler with the four side panels removed, showing the internal construction of the unit.

FIG. 2 shows the evaporative cooler unit 10 with the side panels 13 removed. As can be seen from FIG. 2, the top and base panels 11 and 12 remain firmly secured in the unit even without the side panels, by connection to a molded plastic blower shroud 17 which extends from the base to the top of the unit. This blower shroud may be molded in two sections, as indicated, connected together at a seam flange 18.

The base panel 12 is connected to the blower shroud 17 by bolts or self-tapping screws 19 near corners and at various points as indicated in FIG. 2. The top panel 11 is connected to the blower housing or shroud 17 preferably by horizontally extending bolts or self-tapping screws 21, via flanges 22 (one side indicated in FIG. 2) integrally molded into the top panel 11. The bolts or self-tapping screws may be received in threaded brass (or other non-corrosible metal) inserts fitted into the plastic of the blower housing or the panels. The blower housing is preferably molded of a structural foam material reinforced with fibers, preferably glass fibers. This composite material has the advantages of economy, corrosion resistance, and high strength, being capable of connecting the unit together is discussed above.

FIG. 2 also shows a squirrel-cage type blower 23 within the blower housing, driven by a motor 24 preferably connected to the blower by pulleys 26 and 27 and a belt 28. A pump 29, seen in FIGS. 2 and 3, delivers water from a collection basin 31 formed in the bottom of the base panel 12 through a flexible conduit 32 up to a distribution system in the top panel 11, which will be further discussed below.

Also seen in FIG. 2 are integrally molded studs 33 at corners on the top and bottom panels 11 and 12 for the optional inclusion of four tubular corner posts (not shown) which provide additional support in situations where additional support may be needed. However, in most situations the unit is very sturdy and adequately supported without these posts.

Figure 3:
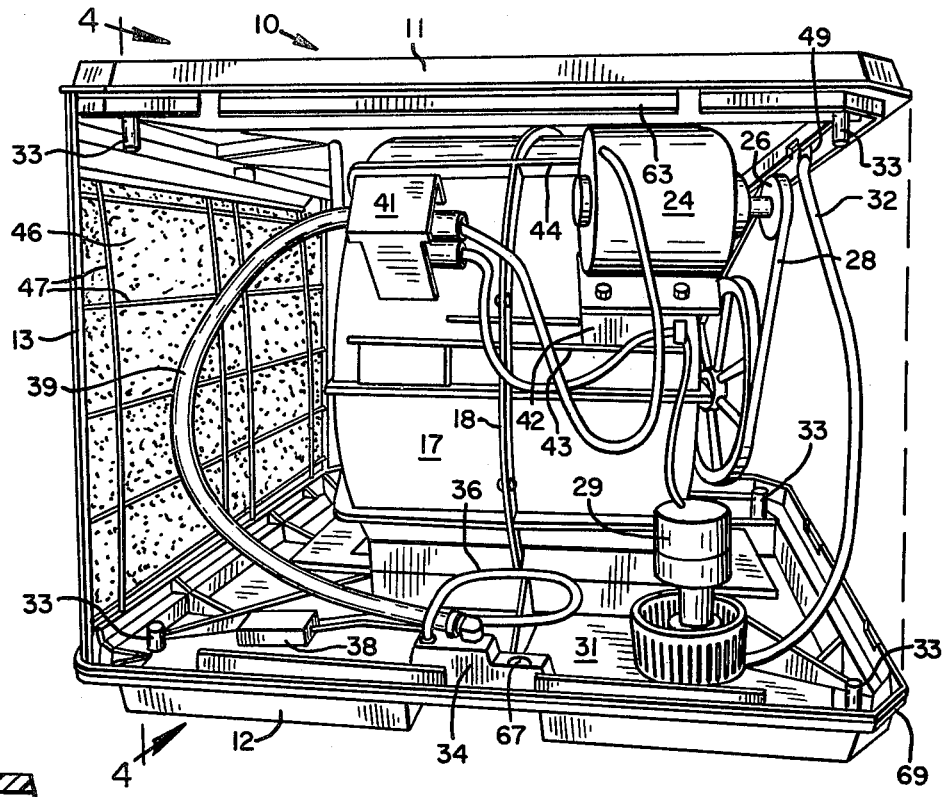
FIG. 3 is a perspective view of the cooler from a different side (to the left in FIG. 2), with one of the side panels in place, but the others removed.

FIG. 3 shows further details of the interior of the evaporative air cooler unit 10, as seen from a different angle from that of FIG. 2. Water is admitted to the unit through a common entry junction box 34 which preferably is integrally molded with the bottom panel 12. The water flows through a piece of tubing 36 (see also FIG. 7) and to a valve 37 controlled by a float 38 on the surface of the water within the collection basin 31. Water is admitted to the basin as needed.

An electrical conduit 39 carries electricity from the entry junction box 34 to an electrical junction 41, and as indicated, power is supplied to the motor 24 and to the pump 29 from here. The motor 24 is mounted on a bracket 42, which in turn is mounted on the blower housing or shroud 17. The shroud preferably includes integral locating stops 43 and 44 for ease of locating the bracket and motor on assembly.

In FIG. 3 a single side panel 13 is shown installed between the top and bottom panels 11 and 12 of the unit 10. Each side panel has retained against its inside surface a sheet or pad of water retaining material 46, secured to the side panel 13 principally by a grid of wires or thin rods 47. This is seen in greater detail in FIGS. 4 and 6. As seen in those figures, the side panel 13 preferably includes a plurality of pins 48, integrally molded with the panel, which pierce the cooler pad 46 and hold it in place, making removal, installation and correct retention of the coolant pads more efficiently accomplished than in prior art coolers. The wire retainer 47, generally similar to those used in prior art evaporative coolers, is held in place at the edges of the side panel 13 by any suitable connection means.

Figure 4:
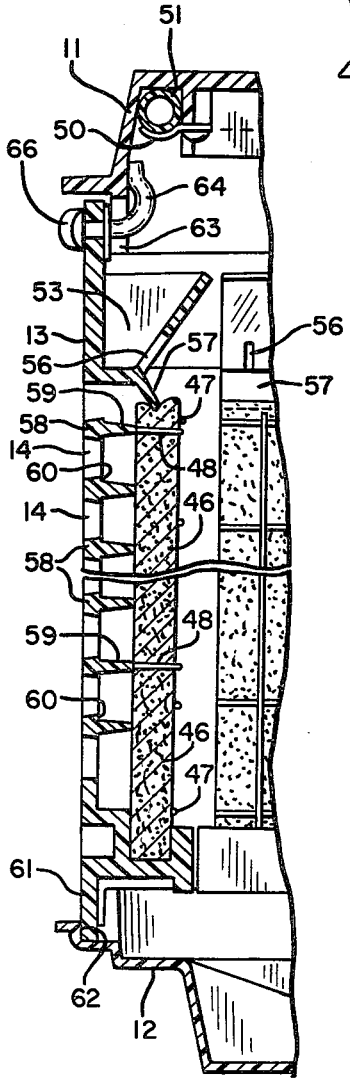
FIG. 4 is a sectional view in elevation of a portion of the unit including a side panel, and showing a part of the water distribution system of the unit, taken along the line 4—4 in FIG. 3.
Figure 5:
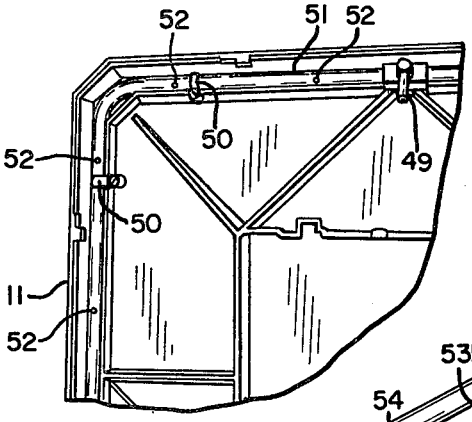
FIG. 5 is a plan view showing a portion of the top panel of the unit, from the underside, and again indicating a portion of the water distribution system.
Figure 6:
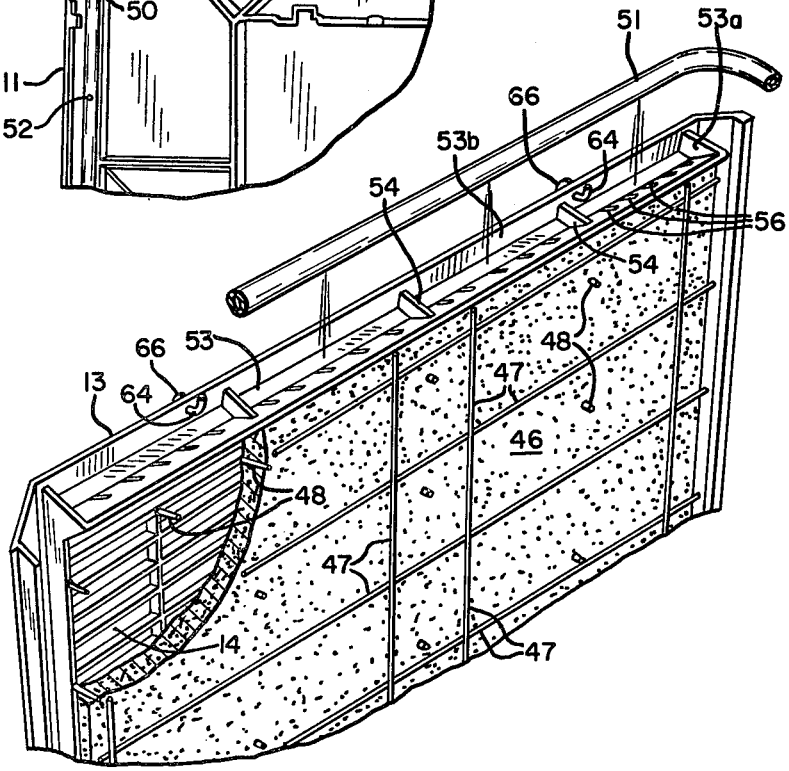
FIG. 6 is a perspective view which schematically indicates the manner in which water is distributed to water-retaining material retained in the side panels.

FIGS. 4, 5 and 6 show details of the water distribution system. The flexible water conduit 32 shown in FIG. 3 leads from the pump 29 up to a fitting 49 (FIG. 5) connected into a water distribution ring 51 which goes around the periphery of the underside of the top panel 11, retained to the top panel 11 by clips 50 connected to the underside of the panel 11. The water distribution ring 51 is a tubular conduit which, as shown FIGS. 4, 5 and 6, has a series of perforations 52 which deliver water under pressure from the pump 29 into a drip trough 53 formed in each of the side panels 13. It is an important feature that the water be delivered under pressure, which may be a low pressure, so that if the unit 10 is somewhat tipped out of level, water nonetheless is distributed substantially evenly around the entire periphery of the unit.

The drip trough 53 of each side panel 13 is preferably divided into multiple sections 53*a*, 53*b*, etc. by dividers 54 as shown in FIG. 6, so that again, if the unit is out of level, the trough will still feed an adequate supply of water to keep the cooler pad 46 entirely wet. Only one water-delivery perforation 52 need be provided in the distribution ring 51 for each section 53*a*, 53*b*, etc., as indicated. In some prior art coolers without trough dividers, even a difference of ¼ inch in level from one corner to the other could result in some areas of the pad being dry at the upper end, and a consequent excess of water in other areas, which can restrict air flow through the pad, resulting in a significant loss of efficiency. In contrast, the cooler 10 of the invention can be out of level by as much as 2 inches over its 40 inch length, with water distribution still adequately even.

As shown in FIGS. 4 and 6, the water from the distribution ring 51 is sprayed into the drip trough 53 and is delivered into the pad 46 via slots 56. An important feature of the water distribution system of this invention is that a drip guide 57 is included in the integrally molded structure, just below the drip slots 56 of the trough, to direct water into the pad 46 and keep water from running down the front of the side panel, as occured on some prior art coolers. Another important feature is that louver structure 58 between the louver openings 14 includes a reverse slope 59, i.e. a slope inclined slightly backwardly into the unit, to direct water back into the pad 46 in the event it should migrate out onto the louver structure 58. Also, the louver structure is shaped to provide a water-stop lip 60 which cooperates with the slope 59 to contain any water which might migrate out that far.

On assembly, the installation of the side panels or louver panels 13 is quickly and efficiently accomplished. Tabs 61 on the bottom of the panel 13, as shown in FIG. 4, fit into corresponding recesses 62, also seen in FIGS. 7 and 8, in the base panel 12. Several of these are included at the bottom of each side panel. The top of the side panel 13 rests against a vertical flange 63. The panel is held in place at the top with rotating latches 64 having external heads 66 preferably adapted for rotation by hand. The overlap of the side panel or louver panel 13 at its top with the vertically depending flange 63 of the top panel and with the base, at the bottom, eliminates any significant passage of air at these joints, even if the fit is not tight.

Figure 9:
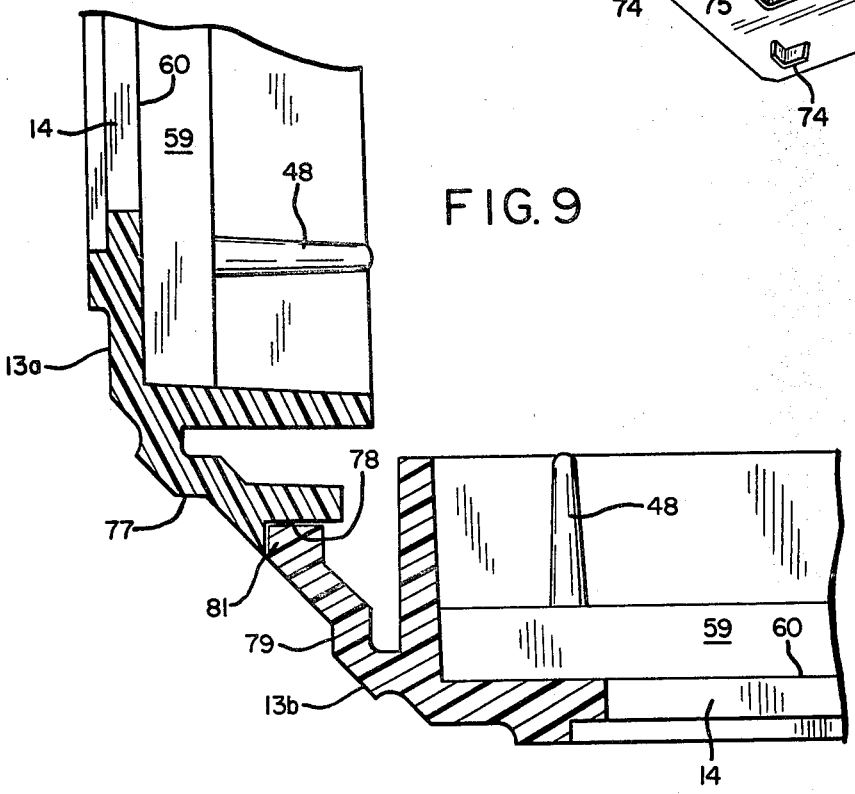
FIG. 9 is a sectional view showing a joint between adjacent louver panels, as seen along the line 9—9 in FIG. 1.

There is a similar overlap of the side panels at the corners, as shown in FIG. 9, with the same effect on elimination of air leakage.

Figure 7:
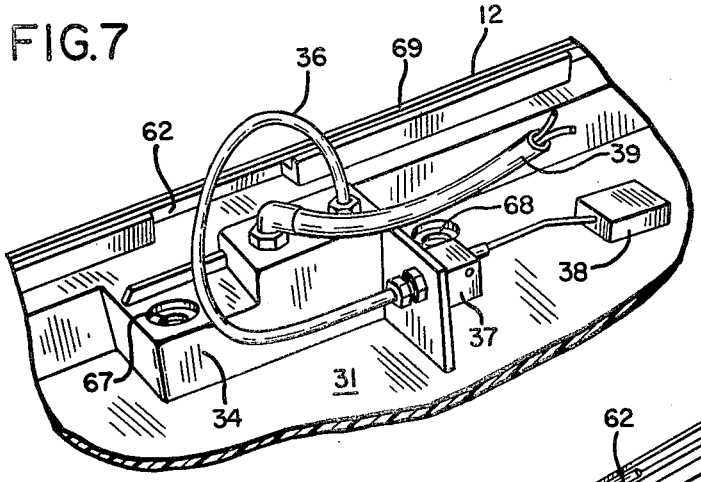
FIG. 7 is a view in perspective showing a portion of the bottom or base panel, at one side, where an electrical conduit and a copper tubing water conduit enter the unit.

FIG. 7 shows the common inlet junction box 34, as described above. Built into the box 34 is an overflow outlet 67 for draining off excess water from the collection basin 31, should an excess occur. FIG. 7 also shows a drain 68 for the unit, formed at a low point in the bottom of the basin 31 of the base panel 12.

The base also includes a raised lip 69, as shown in FIGS. 7 and 3, at its outer periphery to catch any drips or leaks that may venture beyond the confines of the side panel.

Figure 8:
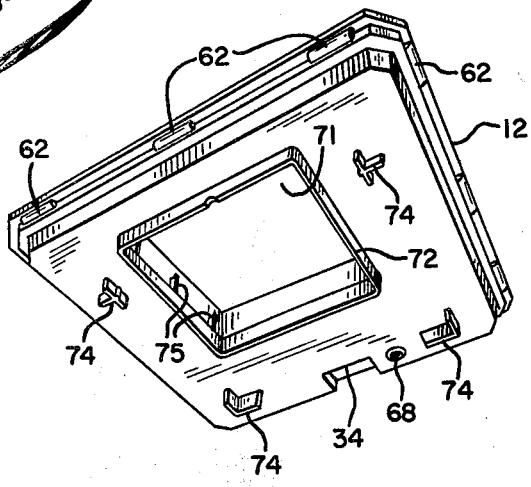
FIG. 8 is a view in perspective showing the underside of the base panel of the evaporative cooler unit.

FIG. 8, showing the underside of the base 12 with a cooled air exit opening 71, illustrates an extension flange 72 on the underside of the base around the opening 71 to make installation of the unit to downstream duct work easier. The duct work (not shown) leads from the exit air opening 72 to the space to be cooled. Also shown in FIG. 8 are feet 74 on the underside of the base to facilitate attachment of the unit to a support frame in a standard installation. At the periphery of the opening 71 there are additionally provided series of tie down brackets 75, provided for mobile home installations where a support frame cannot be fastened to the roof.

FIG. 9 shows, in plan section, the manner in which adjacent louver panels 13*a* and 13*b* abut and overlap at corners. The right edge of each panel 13, as shown on the panel 13*a*, includes a protruding flange structure 77 providing a V-shaped notch 78. The left edge of the adjacent panel (13*b* in FIG. 9) has a protruding flange structure 79 with an end 81 complementarily shaped to nestle in the V-shaped notch 78. As noted above, this overlap-type interfit prevents any significant leakage at corners.

The preferred embodiment described herein is intended to be purely illustrative, and not limiting of the scope of the invention. Other embodiments and variations will be apparent to those skilled in the art and may be made without departing from the essence and scope of the invention as defined in the following claims.

I claim:

1. An evaporative cooler, comprising:

a housing including a top panel, a bottom panel and four side panels;

at least one of the side panels having openings and providing air inlets;

a blower within the housing, including a blower shroud having means for rigidly securing the blower shroud to the top panel and to the bottom panel, said blower shroud fixing the relative positions of the top and bottom panels and supporting the top panel in place with respect to the bottom panel;

means for connecting the four side panels to the top panel and to the bottom panel, such that the side panels can be removed while the top and bottom panels remain secured in position;

water-retaining means attached in the housing adjacent the side panels providing said air inlets, and including water supply and delivery means for wetting the water-retaining means for evaporation of water into the air as it is drawn into the housing through said air inlets; and a cooled air outlet in the housing, connected to the blower outlet, for delivery of the cooled air to a space.

2. The evaporative cooler of claim 1, wherein the blower shroud is molded of fiber-reinforced structural foam, and formed in two sections joined together at a seam lying generally in a vertical plane, with removable fastener means retaining the two sections together.

3. The evaporative cooler of claim 1, wherein the top, bottom and side panels and the blower shroud are all formed of molded plastic material.

4. The evaporative cooler of claim 1, wherein the means for connecting the side panels to the top and bottom panels comprises tabs at the bottom of each side panel and corresponding recesses in the bottom panel edge, and rotating latches at the top of each side panel, for gripping structure of the top panel to hold the side panel in place.

5. The evaporative cooler of claim 1, wherein the water-retaining means comprises a fibrous pad, and wherein the side panels providing air inlets include integrally molded pins extending inwardly into the fibrous pad to help retain it in proper position.

* * * * *